US010415293B2

(12) United States Patent
Tomlinson

(10) Patent No.: US 10,415,293 B2
(45) Date of Patent: Sep. 17, 2019

(54) APPARATUS FOR MINIMIZING CLOSING FORCE OF A DOOR

(71) Applicant: ASSA ABLOY Accessories and Door Controls Group, Inc., Monroe, NC (US)

(72) Inventor: William Holland Tomlinson, Mooreville, MS (US)

(73) Assignee: ASSA ABLOY Accessories and Door Controls Group, Inc., Monroe, NC (US)

( * ) Notice: Subject to any disclaimer, the term of this patent is extended or adjusted under 35 U.S.C. 154(b) by 162 days.

(21) Appl. No.: 15/639,625

(22) Filed: Jun. 30, 2017

(65) Prior Publication Data

US 2018/0002966 A1 Jan. 4, 2018

Related U.S. Application Data

(60) Provisional application No. 62/357,605, filed on Jul. 1, 2016.

(51) Int. Cl.
*E05F 5/02* (2006.01)
*E05F 5/10* (2006.01)

(52) U.S. Cl.
CPC ..... *E05F 5/02* (2013.01); *E05F 5/10* (2013.01); *E05Y 2201/474* (2013.01); *E05Y 2600/46* (2013.01); *E05Y 2900/132* (2013.01)

(58) Field of Classification Search
None
See application file for complete search history.

(56) References Cited

U.S. PATENT DOCUMENTS 1,684,646 A * 9/1928 Snavely ..... E06B 7/18 49/311
3,561,161 A 2/1971 Green
(Continued)

FOREIGN PATENT DOCUMENTS

DE 202006006422 U1 8/2006
DE 102012009500 A1 11/2013
(Continued)

OTHER PUBLICATIONS

Pemko Manufacturing Company, Inc., International Patent Application No. PCT/US2017/013384, International Search Report and Written Opinion, dated Apr. 4, 2017.
(Continued)

*Primary Examiner* — Marcus Menezes
(74) *Attorney, Agent, or Firm* — Moore & Van Allen PLLC; Jeffrey R. Gray

(57) ABSTRACT

An apparatus is provided for minimizing closing force of a door. The apparatus comprises a housing adapted to be disposed in the hinged edge of the door. A piston is slidably mounted in the bore. A button having an inner end and an outer end is disposed in the bore with the inner end of the button engaging the piston for urging the button toward a first extended position where the button extends from the edge of the door. The button is slidable in the bore relative to the housing for reciprocal movement between the extended position and a second position where the button is depressed into the bore against the force of the piston. The button is disposed so that the outer end of the button engages the door frame for slowing movement of the door in a closing direction as the button is moved into the bore to the depressed second position.

13 Claims, 6 Drawing Sheets

(56) References Cited

U.S. PATENT DOCUMENTS

| | | | | |
|---|---|---|---|---|
| 4,471,575 | A | 9/1984 | Stout | |
| 5,468,042 | A | 11/1995 | Heinrichs et al. | |
| 6,052,867 | A | 4/2000 | Haab et al. | |
| 6,438,795 | B1 | 8/2002 | Haab et al. | |
| 6,983,512 | B2 | 1/2006 | De Oliveira | |
| 7,100,907 | B2 | 9/2006 | Fitz et al. | |
| 8,215,061 | B2 | 7/2012 | Gosling et al. | |
| 8,402,606 | B1 | 3/2013 | Tsai | |
| 9,027,283 | B2 | 5/2015 | Beyerle | |
| 2005/0269176 | A1 | 12/2005 | Tomiji et al. | |
| 2006/0207843 | A1* | 9/2006 | Migli | E05F 5/02 188/282.1 |
| 2007/0158885 | A1* | 7/2007 | Lam | E05F 5/02 267/34 |
| 2008/0217126 | A1 | 9/2008 | Bantle et al. | |
| 2008/0295283 | A1* | 12/2008 | Tice | E05C 19/16 16/84 |
| 2009/0044916 | A1 | 2/2009 | Singiser et al. | |
| 2009/0090587 | A1 | 4/2009 | Tomita | |
| 2009/0094789 | A1 | 4/2009 | Bereznai | |
| 2009/0260188 | A1* | 10/2009 | Lange | E05C 17/305 16/412 |
| 2010/0212109 | A1* | 8/2010 | Kim | E05F 5/006 16/85 |
| 2011/0041284 | A1 | 2/2011 | Kimura et al. | |
| 2011/0099909 | A1 | 5/2011 | Stommel et al. | |
| 2011/0283478 | A1* | 11/2011 | Berry | E05F 5/02 16/54 |
| 2012/0060419 | A1 | 3/2012 | Riggs | |
| 2013/0061425 | A1 | 3/2013 | Inaguchi | |
| 2013/0167444 | A1 | 7/2013 | Ryden et al. | |
| 2013/0333292 | A1 | 12/2013 | Beyerle | |
| 2014/0059801 | A1 | 3/2014 | Saito | |
| 2015/0137436 | A1 | 5/2015 | Fitterling et al. | |
| 2017/0204646 | A1* | 7/2017 | Tomlinson | E05F 3/02 |

FOREIGN PATENT DOCUMENTS

| | | | | |
|---|---|---|---|---|
| EP | 2218989 | A2 * | 8/2010 | E05D 3/06 |
| EP | 2286048 | A1 | 2/2011 | |
| FR | 2267439 | A1 * | 11/1975 | E05F 5/08 |
| FR | 2267439 | A1 | 11/1975 | |
| GB | 861627 | A * | 2/1961 | E05F 5/02 |
| GB | 2371326 | A | 7/2002 | |
| JP | 2007182714 | A | 7/2007 | |
| WO | WO-2006059860 | A1 * | 6/2006 | E05F 5/02 |
| WO | 2009141044 | A1 | 11/2009 | |
| WO | WO-2009132759 | A1 * | 11/2009 | E05F 5/02 |
| WO | 2011121621 | A1 | 10/2011 | |
| WO | WO-2015182468 | A1 * | 12/2015 | F16F 7/00 |
| WO | 2017123908 | A1 | 7/2017 | |

OTHER PUBLICATIONS

Pemko Manufacturing Co, International Patent Application No. PCT/US2017/040345, International Search Report and Written Opinion, dated Oct. 9, 2017.

U.S. Appl. No. 15/405,709, Office Action, dated Jul. 5, 2018.

Assa Abloy Accessories and Door Controls Group, Inc., International Patent Application No. PCT/US2017/040345, International Preliminary Report on Patentability, dated Jan. 10, 2019.

U.S. Appl. No. 15/405,709, Final Office Action, dated Jan. 22, 2019.

U.S. Appl. No. 15/405,709, Notice of Allowance, dated Mar. 13, 2019.

* cited by examiner

APPARATUS FOR MINIMIZING CLOSING FORCE OF A DOOR

CROSS-REFERENCES

This application is related to U.S. Provisional Application No. 62/357,605, filed Jul. 1, 2016, entitled "ANTI-SLAM DEVICE AND SYSTEM", naming William Holland Tomlinson as the inventor. The contents of the provisional application are incorporated herein by reference in their entirety, and the benefit of the filing date of the provisional application is hereby claimed for all purposes that are legally served by such claim for the benefit of the filing date.

BACKGROUND

An apparatus for minimizing closing force of a door is described for use in slowing and dampening movement of a door and, more particularly, a door closing force minimization apparatus is described for slowing movement and providing a dampening effect to a closing door as the door approaches a closed position.

Self-closing door hinges are used on a door for providing a closing force to an open door in a door frame. Self-closing hinges are generally spring-loaded for automatically moving the door to a closed position where the door substantially blocks an opening defined by the door frame in a wall or other structure. As the door opens, the spring tension increases and, when the door is released, the spring tension is released for automatically returning the door to the closed position. A problem with self-closing hinges is that the closing force generated is significant for normal operation of the door. As the moving door reaches the closed position, the door can forcefully contact the door frame due to a rapid moving speed of the door. As a result, the door tends to close with a loud noise akin to the door being slammed shut.

For the foregoing reasons, there is a need for a new device for slowing the movement of a closing door approaching a closed position. The new device should slow the door as the door reaches the closed position in order to prevent the door from loudly hitting a door frame when the door is shut too forcefully or at a high rate of speed. The new device should absorb some of the forces exerted as the door is being closed and resist the motion of the closing door. Ideally, the new device can be a part of a damping system designed for resisting and reducing the speed and force of the closing door to produce a quieter closing action.

SUMMARY

An apparatus is provided for minimizing closing force of a door pivotally mounted at one edge in a door frame at least partially defining an opening. The door is sized and shaped to cover the opening defined by the door frame in a closed position of the door. The door closing force minimization apparatus comprises a housing including an inner surface defining a longitudinal bore with a closed end and an open end. A piston is slidably mounted in the bore. The piston includes a hollow cylinder closed at both a proximal end and a distal end, a piston head moveable within said cylinder, a piston rod connected to the piston head and slidingly extending through the distal end of the cylinder for engaging the inner surface of the housing at the closed end of the bore, and a compression spring disposed on the piston rod between the distal end of the cylinder and the piston head. A button having an inner end and an outer end is disposed in the bore. The inner end of the button engages the proximal end of the piston for urging the button toward a first extended position where the outer end of the button extends from the open end of the housing. The button is slidable in the bore relative to the housing for reciprocal movement between the first extended position and a second position where the button is depressed into the bore against the force of the piston. The housing is adapted to be disposed in the edge of the door so that the outer end of the button engages the door frame for slowing movement of the door panel in a closing direction as the button is moved into the bore in a direction from the first position to the depressed second position.

In one aspect, a radial flange extends outwardly from an outer surface of the housing proximate the open end of the bore. A stop plate defining an opening is configured to be mounted to the flange on the housing such that the opening is aligned with the bore for slidingly receiving the button for movement of the button relative to the stop plate. A radial flange extends outwardly from an outer surface of the button proximate the inner end of the button. The diameter of the flange on the button is larger than the opening in the stop plate engaging the stop plate at the first position of the button. In the depressed second position, the outer end of the button is contiguous with the stop plate.

In another aspect, a second spring is disposed in the cylinder between the piston head and the closed proximal end of the cylinder.

In a still further aspect, the piston is a pneumatic device and the cylinder accommodates a pneumatic medium as an operating fluid to cause fluid damping. In one embodiment, the pneumatic medium is air and in another the pneumatic medium is hydraulic fluid.

A door is also provided, comprising a door frame adapted for at least partially defining an opening in a wall. A door panel is pivotally mounted at one edge in the door frame. The door panel is sized and shaped to cover the opening defined by the door frame in a closed position of the door. An apparatus is provided for minimizing closing force of the door panel. The door closing force minimization apparatus comprises a housing including an inner surface defining a longitudinal bore with a closed end and an open end. A piston is slidably mounted in the bore. The piston includes a hollow cylinder closed at both a proximal end and a distal end, a piston head moveable within the cylinder, a piston rod connected to the piston head and slidingly extending through the distal end of the cylinder for engaging the inner surface of the housing closed end of the bore, and a compression spring disposed on the piston rod between the distal end of the cylinder and the piston head. A button having an inner end and an outer end is disposed in the bore with the inner end of the button engaging the proximal end piston for urging the button toward a first extended position where the outer end of the button extends from the open end of the housing. The button is slidable in the bore relative to the housing for reciprocal movement between the first extended position and a second position where the button is depressed into the bore against the force of the piston. The housing is disposed in the edge of the door so that the outer end of the button engages the door frame for slowing movement of the door panel in a closing direction as the button is moved into the bore in a direction from the first position to the depressed second position for minimizing closing force of the door panel.

In an further aspect, the door closing force minimization apparatus comprises a plurality of door closing force minimization apparatuses disposed in the edge of the door panel.

BRIEF DESCRIPTION OF THE DRAWINGS

For a more complete understanding of the anti-slam device, reference should now be had to the embodiments shown in the accompanying drawings and described below. In the drawings.

DESCRIPTION

Figure 1:
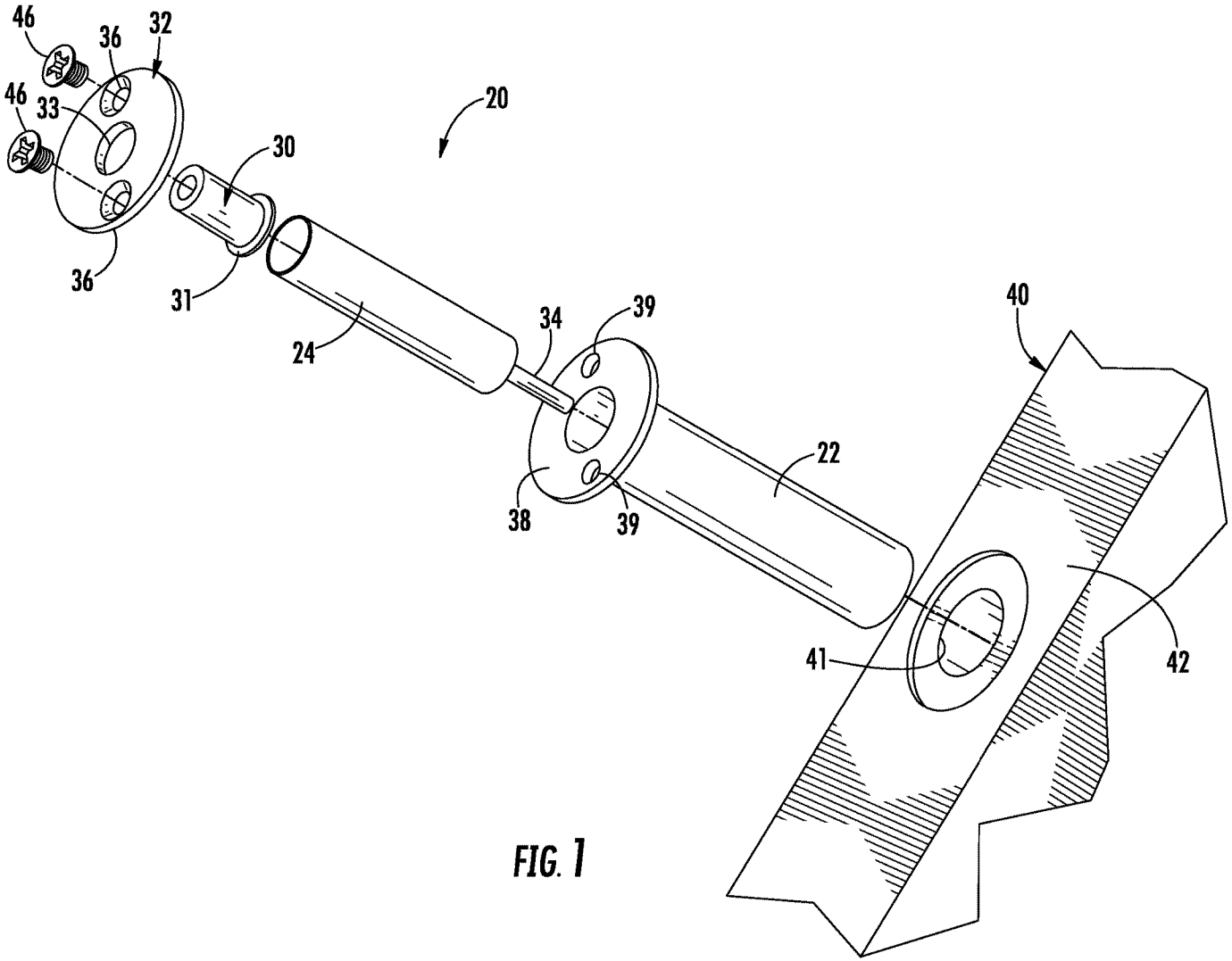
FIG. 1 is an exploded perspective view of an embodiment of an apparatus for minimizing closing force of a door and a cut-away portion of a hinged edge of a door.
Figure 2:
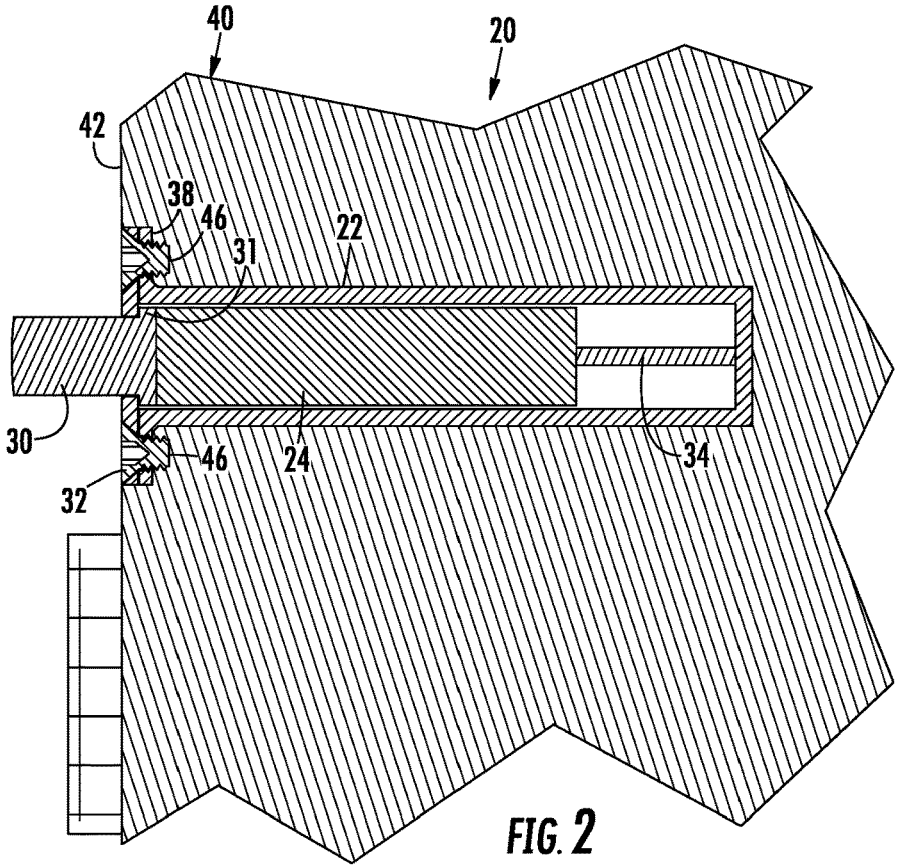
FIG. 2 is a longitudinal cross-section view of the apparatus for minimizing closing force of a door in the hinged edge of the door as shown in FIG. 1.
Figure 3:
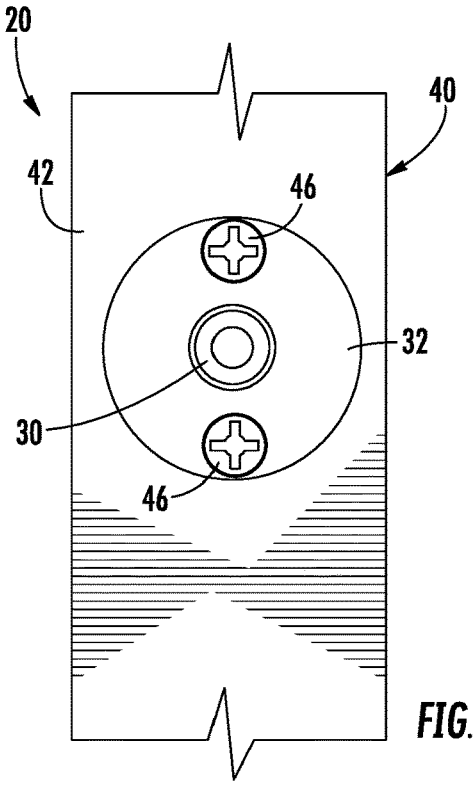
FIG. 3 is an end elevation view of the apparatus for minimizing closing force of a door in the hinged edge of the door as shown in FIG. 1.

Referring now to the drawings, wherein like reference numerals indicate the same or similar elements throughout the several views, an apparatus for minimizing closing force of a hinged door is shown in FIGS. 1-3 and generally designated at 20. For the purposes of this description, the door closing force minimization apparatus will referred to an "anti-slam" device. The anti-slam device 20 comprises a cylindrical case 22 for accommodating a piston 24 linearly displaceable within the case 22, a reciprocating contact button 30, and a cover plate 32.

The case 22 comprises an elongated generally hollow tubular body closed at an inner end and adapted to be disposed in a corresponding opening 41 in the hinged edge 42 of the door 40. The case 22 is configured for receiving and supporting linear reciprocal movement of the piston 24 and the contact button 30. Accordingly, the inside diameter of the case 22 corresponds to the diameter of the piston 24. As shown in FIGS. 1 and 2, an outer open end of the case 22 may further include a circular radially extending flange 38. The flange 38 has a pair of opposed fastener holes 39 radially disposed from the opening in the case 22.

Figure 7:
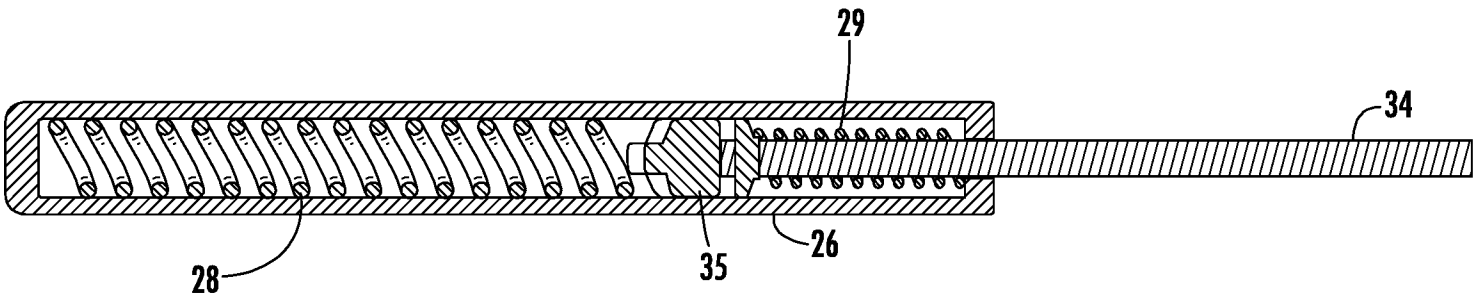
FIG. 7 is a longitudinal cross-section of a piston for use with the apparatus for minimizing closing force of a door device as shown in FIG. 1.

The piston 24 includes a cylinder 26 and a piston rod 34. The cylinder 26 comprises a cylindrical housing closed at one end and defining a bore for slidably receiving the piston rod 34. The piston rod 34 partially extends from the cylinder 26 such that the inner end of the piston rod 34 sits against the inner surface of the closed end of the case 22. Referring to FIG. 7, the piston rod 34 and piston head 35 form a plunger which is configured to linearly reciprocate within the cylinder 26 such that the inner surface of the cylinder 26 guides the piston 24 to retract and extend when acted upon by the moving door. The piston 24 can be either a pneumatic damping device or a hydraulic damping device for providing a damping and resistance force to the piston head 35 when the piston rod 34 is driven into the housing 26.

In the embodiment shown, the piston 24 is a hydraulic damping device having compression direction damping and active return provided by an internal spring 28. A second coil spring 29 is disposed around the piston rod 34 internal to the cylinder 26 between the piston head 35 and the distal end of the cylinder 26. The first spring 28 is a coil compression spring and may be disposed between the closed end of the cylinder 26 and the piston head 35. As will be described below, the moving door exerts force upon the anti-slam device 20 causing the piston rod 34 to be forced into the cylinder 26 and compressing the spring 28 between the piston head 35 and the closed end of the cylinder 26. Hydraulic damping slows movement of the door. In addition, as the spring 28 compresses, the spring 28 works against the moving door and creates resistance against the exerted forces of the door thereby further dampening and reducing the speed of the door. Various compression springs having different amounts of stored mechanical energy may be used depending on how much resistance is desired to dampen and slow the closing door. In one embodiment, the compression spring 28 may only be necessary for aiding return of the piston to an extended position for a heavier door.

The case 22 and the piston 24 may be made out of any suitable rigid material resistant to deforming when force is exerted upon them. Such suitable material may include but not be limited to, for example, metal, plastic, fiberglass, PFTE, or a combination thereof.

The contact button 30 (FIG. 1) is a short cylindrical member having a body portion and a radially extending lip 31 at an inner end. The diameter of the lip 31 matches the diameter of the piston 24 and the inner diameter of the case 22 (FIG. 2).

Referring to FIGS. 1-3, the cover plate 32 is a circular planar member defining a central circular opening 33. The cover plate 32 has a pair of opposed fastener holes 36 radially spaced from the opening 33. The fastener holes 36 correspond to the fastener holes 39 in the flange 38 of the case 22 such that the cover plate 32 can be secured through the flange 38 of the case 22 to the door 40 with threaded fasteners 46. As shown in FIG. 2, the diameter of the opening 33 in the cover plate 32 is smaller than the inner diameter of the case 22. In addition, the diameter of the opening 33 in the cover plate 32 corresponds to the diameter of the contact button 30 such that the contact button 30 slides freely in the opening 33. When the cover plate 32 is secured to the case 22, the wider lip 31 of the contact button 30 contacts the cover plate 32 to prevent the contact button 30 from escaping the case 22.

Figure 4:
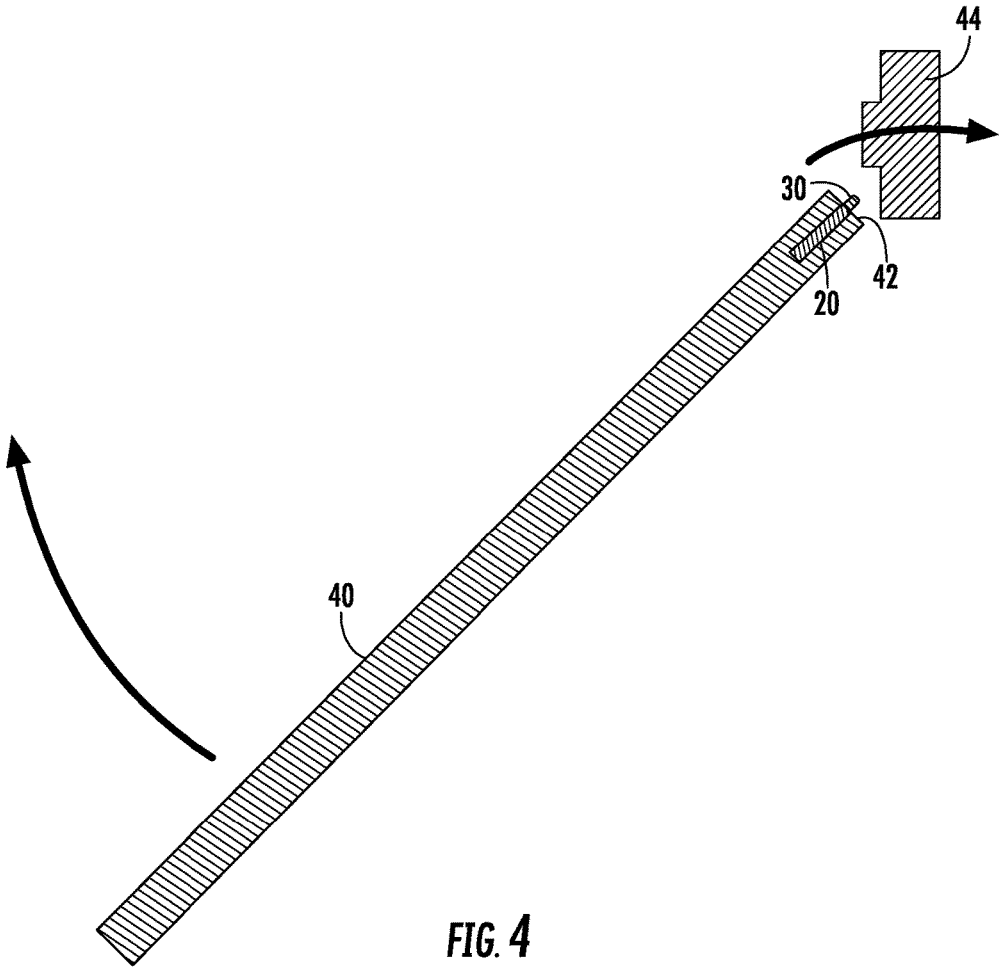
FIG. 4 is a schematic top transverse cross-section view of the apparatus for minimizing closing force of a door and a door panel in a door frame with the door in an open position.
Figure 5:
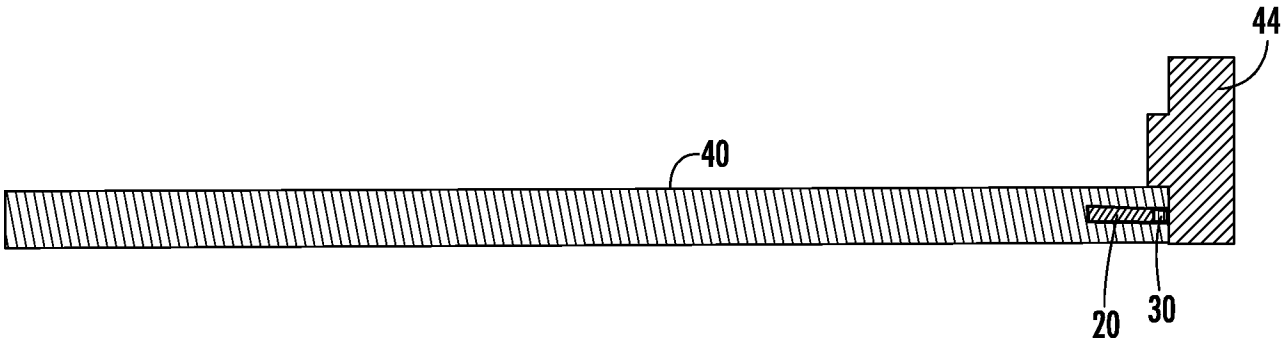
FIG. 5 is a schematic top transverse cross-section view of the apparatus for minimizing closing force of a door and the door panel in the door frame as shown in FIG. 4 with the door in a closed position.

In use, as shown in FIGS. 4 and 5, the anti-slam device 20 is mounted in an opening 41 in the hinged edge 42 of a swinging door 40. The opening 41 in the edge 42 of the door 40 is countersunk such that the flange 38 of the cover plate 32 fits flush with the edge 42 of the door 40. The anti-slam device 20 is positioned for engaging the door frame 44 as the door 42 approaches the closed position. In a first position of the anti-slam device 20 prior to engagement with the frame 44 (FIG. 4), a length of the body portion of the contact button 30 extends from the case 22 and through the cover plate 32. As can be seen in FIG. 2, in this position the contact button 30 extends from the end of the case 22 in a direction generally transverse to the longitudinal axis of the door 40.

Figure 6:
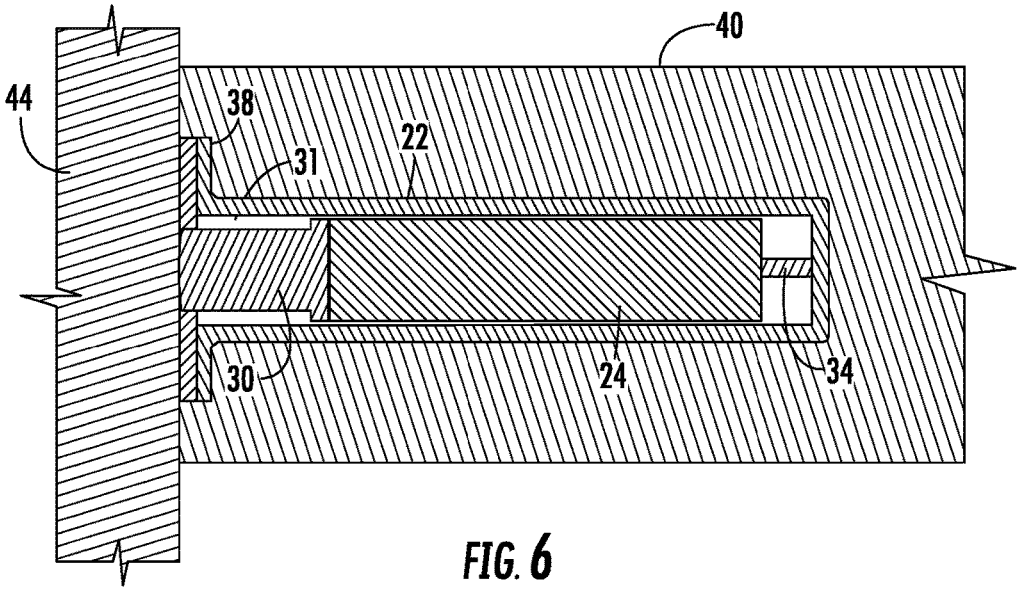
FIG. 6 is a close-up schematic top transverse cross-section view of the apparatus for minimizing closing force of a door and a portion of the door panel in the door frame as shown in FIG. 5 with the door in a closed position.

In application with a self-closing hinge, spring tension in the hinge 50 is generated during opening of the door 40 for automatically returning the door to the closed position when the door is released. As the door 40 is closing, the contact button 30 moving with the door 42 engages the door frame 44. As the door 42 continues closing, force is exerted on the contact button 30 and the piston 24 which are forced into the case 22. The spring 28 engages the inner surface of the closed end of the cylinder 26 and compresses as the piston rod 34 moves further into the cylinder 26. Resistance is created by the hydraulic pressure of, for example, oil in the cylinder 26 and the spring 28 as it compresses. The resistance force acts against the piston 24 and the moving door 40 and the exerted forces such that the retracting movements of the piston 24 and the closing door are dampened and slowed. The dampening of the moving door causes the door to slow and any noise or slamming of the door, as would occur if the door was suddenly stopped by the frame 44, will be minimized if not completely avoided. When the door 40 reaches the closed position, the anti-slam device 20 is in a second, compressed position (FIGS. 5 and 6).

When the door 42 is opened, the hinged edge 42 of the door 40 moves away from the frame 44 and the force exerted by the anti-slam device 20 is released. The piston 24 and the contact button 30 are driven by the spring 28 to the first position with the body portion of the contact button 30 extends from the case 22 as the wider lip 31 contacts the inner surface of the cover plate 32.

Although the anti-slam device 20 is described herein as used in an application with a self-closing hinge, it is understood that the anti-slam device 20 can be used in any door application where the door is moved automatically to the closed position proximate the door frame 44. The anti-slam device 20 can also be used in manual door applications where enough closing force is generated to overcome the outward biasing force of the piston 24. The anti-slam device 20 is particularly useful in a retrofit situation as the device may be installed in an existing door 42. Although a single anti-slam device is shown in the door 40 in the FIGs., depending on the size and weight of the door, multiple anti-slam devices may be mounted in the door 40 or the door frame 44 to more effectively damp the motion of a moving door to produce a soft action based upon the given application.

The various embodiments of the anti-slam device 20 described herein may have application to many other areas using swinging doors or other equipment, including furniture, cabinetry, and vehicles such as cars, trucks, vans, buses, trains, aircraft, boat, motor vehicles or the like. In particular, the anti-slam device 20 is directed to dampen and slow down and stop the movement of a moving component. As will further be readily apparent, the anti-slam device 20 can be adapted for use on all types of doors and is not limited to use on residential household or commercial doors for ingress or egress. For example, the device can be used on kitchen or household appliances such as refrigerators and microwaves and all types of items that allow a person access to an interior portion thereof through some type of swinging door-like or lid type structure.

Although the apparatus for minimizing closing force of a door has been shown and described in considerable detail with respect to only a few exemplary embodiments thereof, it should be understood by those skilled in the art that we do not intend to limit the invention to the embodiments since various modifications, omissions and additions may be made to the disclosed embodiments without materially departing from the novel teachings and advantages, particularly in light of the foregoing teachings. Accordingly, we intend to cover all such modifications, omission, additions and equivalents as may be included within the spirit and scope of the description of anti-slam device as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

We claim:

1. A door closing force minimization apparatus for minimizing a door closing force of a door pivotally mounted at an edge in a door frame at least partially defining a door opening, the door sized and shaped to cover the door opening defined by the door frame in a closed position of the door, the door closing force minimization apparatus comprising:

a housing including an inner surface defining a bore with a closed end and an open end, and an outer surface with a radial housing flange extending outwardly from the outer surface of the housing proximate the open end of the bore;

a stop plate defining an opening, wherein the stop plate is configured to be mounted to the radial housing flange on the housing, and wherein the stop plate is configured to be directly mounted with fasteners to the radial housing flange on the housing and extending parallel to the radial housing flange on the housing such that the opening of the stop plate is aligned with the bore;

a piston slidably mounted in the bore, the piston including a hollow cylinder having a proximal end and a distal end, a piston head moveable within the cylinder, a piston rod connected to the piston head and slidingly extending through the distal end of the cylinder for engaging the inner surface of the closed end of the bore of the housing, and a compression spring disposed within the cylinder; and a button having an inner end and an outer end, and an outer surface having a radial button flange extending outwardly from the outer surface proximate the inner end of the button, the radial button flange having a diameter larger than the opening in the stop plate, the button disposed in the bore with the inner end of the button engaging the proximal end of the piston for urging the button toward a first extended position where the outer end of the button extends from the open end of the housing through the opening of the stop plate and the radial button flange engages the stop plate, the button slidable in the bore relative to the housing for reciprocal movement between the first extended position and a second position where the button is depressed into the bore against a piston force, wherein the housing is adapted to be disposed in an edge of the door so that the outer end of the button engages the door frame for slowing movement of the door in a closing direction as the button is moved into the bore in a direction from the first extended position to the second position.

2. The door closing force minimization apparatus as recited in claim 1, wherein in the second position the outer end of the button is contiguous with the stop plate.

3. The door closing force minimization apparatus as recited in claim 1, further comprising a second spring disposed in the cylinder between the piston head and the distal end of the cylinder, and wherein the compression spring is disposed in the cylinder between the piston head and the proximate end of the cylinder.

4. The door closing force minimization apparatus as recited in claim 1, wherein the piston is a pneumatic device and the cylinder accommodates a pneumatic medium as an operating fluid to cause fluid damping.

5. The door closing force minimization apparatus as recited in claim 4, wherein the pneumatic medium is air.

6. The door closing force minimization apparatus as recited in claim 4, wherein the pneumatic medium is hydraulic fluid.

7. A door comprising:

a door frame adapted for at least partially defining a door opening in a wall;

a door panel sized and shaped to cover the door opening defined by the door frame in a closed position of the door, the door panel pivotally mounted at an edge in the door frame; and a door closing force minimization apparatus for minimizing a door closing force of the door panel, the door closing force minimization apparatus comprising a housing including an inner surface defining a bore with a closed end and an open end, and an outer surface with a radial housing flange extending outwardly from the outer surface of the housing proximate the open end of the bore;

a stop plate defining an opening, wherein the stop plate is configured to be mounted to the radial housing flange on the housing, and wherein the stop plate is configured to be directly mounted with fasteners to the radial housing flange on the housing and extending parallel to the radial housing flange on the housing such that the opening of the stop plate is aligned with the bore;

a piston slidably mounted in the bore, the piston including a hollow cylinder having a proximal end and a distal end, a piston head moveable within the cylinder, a piston rod connected to the piston head and slidingly extending through the distal end of the cylinder for engaging the inner surface of the closed end of the bore of the housing, a compression spring disposed within the cylinder; and a button having an inner end and an outer end, and an outer surface having a radial button flange extending outwardly from the outer surface proximate the inner end of the button, the radial button flange having a diameter larger than the opening in the stop plate, the button disposed in the bore with the inner end of the button engaging the proximal end of the piston for urging the button toward a first extended position where the outer end of the button extends from the open end of the housing through the opening of the stop plate and the radial button flange engages the stop plate, the button slidable in the bore relative to the housing for reciprocal movement between the first extended position and a second position where the button is depressed into the bore against a piston force, wherein the housing is disposed in an edge of the door panel so that the outer end of the button engages the door frame for slowing movement of the door panel in a closing direction as the button is moved into the bore in a direction from the first extended position to the second position for minimizing the door closing force of the door panel.

8. The door as recited in claim 7, wherein in the second position the outer end of the button is contiguous with the stop plate.

9. The door as recited in claim 7, further comprising a second spring disposed in the cylinder between the piston head and the distal end the cylinder, and wherein the compression spring is disposed in the cylinder between the piston head and the proximate end of the cylinder.

10. The door as recited in claim 7, wherein the piston is a pneumatic device and the cylinder accommodates a pneumatic medium as an operating fluid to cause fluid damping.

11. The door as recited in claim 10, wherein the pneumatic medium is air.

12. The door as recited in claim 10, wherein the pneumatic medium is hydraulic fluid.

13. The door as recited in claim 7, wherein the door closing force minimization apparatus comprises a plurality of door closing force minimization apparatuses disposed in the edge of the door panel.

* * * * *